US005511846A

United States Patent [19]

Fuller

[11] Patent Number: 5,511,846

[45] Date of Patent: Apr. 30, 1996

[54] RUGGED SCUBA TANK CARRIER

[75] Inventor: Mark A. Fuller, Graham, N.C.

[73] Assignee: Fuller Specialty Co., Inc., Burlington, N.C.

[21] Appl. No.: 317,388

[22] Filed: Oct. 4, 1994

Related U.S. Application Data

[63] Continuation-in-part of Ser. No. 125,191, Sep. 23, 1993, Pat. No. 5,423,586.

[51] Int. Cl.[6] ..... A45C 13/26; B65D 30/06

[52] U.S. Cl. ..... 294/149; 383/117; 383/119

[58] Field of Search ..... 294/31.2, 137, 294/141, 142, 149–157, 165; 150/154; 206/315.1, 446; 220/694, 724, 737, 752, 754, 758, 759; 224/202, 205, 209, 214, 250, 259, 262; 383/6, 7, 12, 13, 16–18, 72, 117, 119, 127; 405/185, 186

[56] References Cited

U.S. PATENT DOCUMENTS

| | | | |
|---|---|---|---|
| 526,566 | 9/1894 | Field | 383/121 X |
| 684,234 | 10/1901 | Haywood | 383/117 X |
| 1,677,583 | 7/1928 | Cromwell | 383/119 X |
| 2,253,688 | 8/1941 | Collins | 383/117 X |
| 2,495,391 | 1/1950 | Smith . | |
| 2,746,582 | 5/1956 | Cart | 383/18 X |
| 2,982,105 | 5/1961 | Akers . | |
| 3,105,359 | 10/1963 | Ellis . | |
| 3,132,390 | 5/1964 | Boden . | |
| 3,135,098 | 6/1964 | Root . | |
| 3,599,690 | 8/1971 | Christie . | |
| 3,921,872 | 11/1975 | Buell, Jr. . | |
| 4,062,392 | 12/1977 | Ishi . | |
| 4,102,019 | 7/1978 | Boden . | |
| 4,109,692 | 8/1978 | Brown . | |
| 4,310,110 | 1/1982 | Dexter . | |
| 4,438,764 | 3/1984 | Eppolito | 224/259 X |
| 4,775,082 | 10/1988 | Krache . | |
| 4,804,218 | 2/1989 | Hilliard | 294/31.2 |
| 5,050,999 | 9/1991 | Van Loon, III . | |

FOREIGN PATENT DOCUMENTS

| | | | |
|---|---|---|---|
| 2592628 | 7/1987 | France | 405/186 |

OTHER PUBLICATIONS

Sales Brochure by Wenoka–Sea Style®—undated.

*Primary Examiner*—Johnny D. Cherry
*Attorney, Agent, or Firm*—Rhodes Coats & Bennett

[57] ABSTRACT

A carrier for a scuba tank having a nipple end and a bottom end and being of a specific size includes a porous bag open at one end and sized to be snugly fitted onto the scuba tank from over the bottom end of the scuba tank. A closure for the open end of the bag permits selective opening and closing of the open end, and a strap has a first portion sewn to the bag and in encircling relation to at least a portion of the bag and handle portion. The fabric bag can be snugly fitted onto the scuba tank from over the bottom end of the scuba tank, the open end of the bag can be closed by the closure and the combined scuba tank and bag may be conveniently carried using the strap handle portion as a handle, with the first portion of the strap providing support for the tank. The carrier has a woven nylon bottom to provide abrasion resistance and an upper portion as mesh fabric allowing the carrier to remain on the tank during a dive.

9 Claims, 2 Drawing Sheets

RUGGED SCUBA TANK CARRIER

This application is a continuation-in-part of my co-pending application Ser. No. 08/125,191 filed 23 Sep. 1993, now U.S. Pat. No. 5,423,586.

BACKGROUND OF THE INVENTION

The present invention relates to improvements in carriers for scuba diving tanks and other similar tanks.

In the art of scuba diving, a diver wears a generally cylindrically-shaped tank of compressed air on his or her back while submerged under water. The compressed air has an outlet through a nipple end of the tank, a regulator and a hose to provide air to the diver to breathe while under water.

When the tank is depleted of the compressed air, it is conventional to refill the tank through an air compressor facility which may or may not be conveniently near the dive site. Accordingly, it is often necessary to transport the tanks from one place to another for use, for filling and for storage.

Heretofore, efforts have been made to provide devices to assist in carrying scuba tanks, as shown in U.S. Pat. No. 3,921,872 to Buell, Jr. which discloses a gas cylinder carrier of a rigid material so that it serves as a piece of luggage for the cylinder. Also, U.S. Pat. No. 4,804,218 to Hilliard discloses a scuba tank harness which is clamped to the tank transport and removed end of line However, the prior art tank carriers add expense and complications to the tank-carrying function. For example, in both of the two above-mentioned patents, when the tanks are delivered to the dive site, the devices must be removed from the tank before the tank can be used. This adds an additional complication to preparing for a dive. Also, during the dive, the carrying devices must be stored, and if the dive is from a boat, this can be a problem because spaced is at a premium. Furthermore, the devices shown in the two above-mentioned patents both appear to be expensive to fabricate.

Accordingly, there is a need in the art for an inexpensive, convenient carrier for scuba tanks. My prior application provided a solution to that need, and this application discloses a further improvement to assist the carrier in resisting abrasion when the tank is dragged on an abrasive surface.

SUMMARY OF THE INVENTION

The present invention fulfills this need in the art by providing a carrier for a scuba tank having a nipple end and a bottom end and being of a specific size. The carrier includes a porous fabric bag open at one end and sized to be snugly fitted onto the scuba tank from over the bottom end of the scuba tank. The improved carrier has a bottom bag section of a fabric made of any abrasion-resistant fiber such as nylon. A closure for the open end of the bag permits selective opening and closing of the open end. A strap has a first portion sewn to the bag and in encircling relation to part of the bag and a handle portion. The bag can be snugly fitted onto the scuba tank from over the bottom end of the scuba tank, the open end of the bag can be closed by the closure and the combined scuba tank and bag may be conveniently carried using the strap handle portion as a handle, with the first portion of the strap providing support for the tank.

In a preferred embodiment the fabric of the upper portion of the bag is a raschel warp knit mesh fabric that has been heat-set to remove most of its stretch. The fabric for the bag bottom is preferably woven nylon or a stronger fiber such as Nomex, Kevlar or Spectra. Since these latter fibers are more expensive, nylon is preferred. The nylon may be nylon-6, nylon-6-6, or Cordura nylon. The bag may be of a size to fit on a tank of a size selected from the group consisting of 50CF, 63CF, 80CF, 10 liter, 12 liter and 15 liter, or any other scuba tank size. The closure is a drawstring closure. Other type closure methods may be used.

Preferably, the strap is a single strap having a first end sewn to the bag, a first continuation forming a first handle loop, a second continuation sewn to and partially encircling the bag, a third continuation forming a second handle loop, and a fourth continuation sewn to and partially encircling the bag and substantially meeting the first end. Thus, the strap forms a saddle supporting the carried tank. Desirably, the strap is sewn to the bag at stress points with a box X stitch.

BRIEF DESCRIPTION OF THE DRAWINGS

The invention will be better understood after a reading of the detailed description of a preferred embodiment and a study of the drawings in which.

DETAILED DESCRIPTION OF A PREFERRED EMBODIMENT

Figure 1:
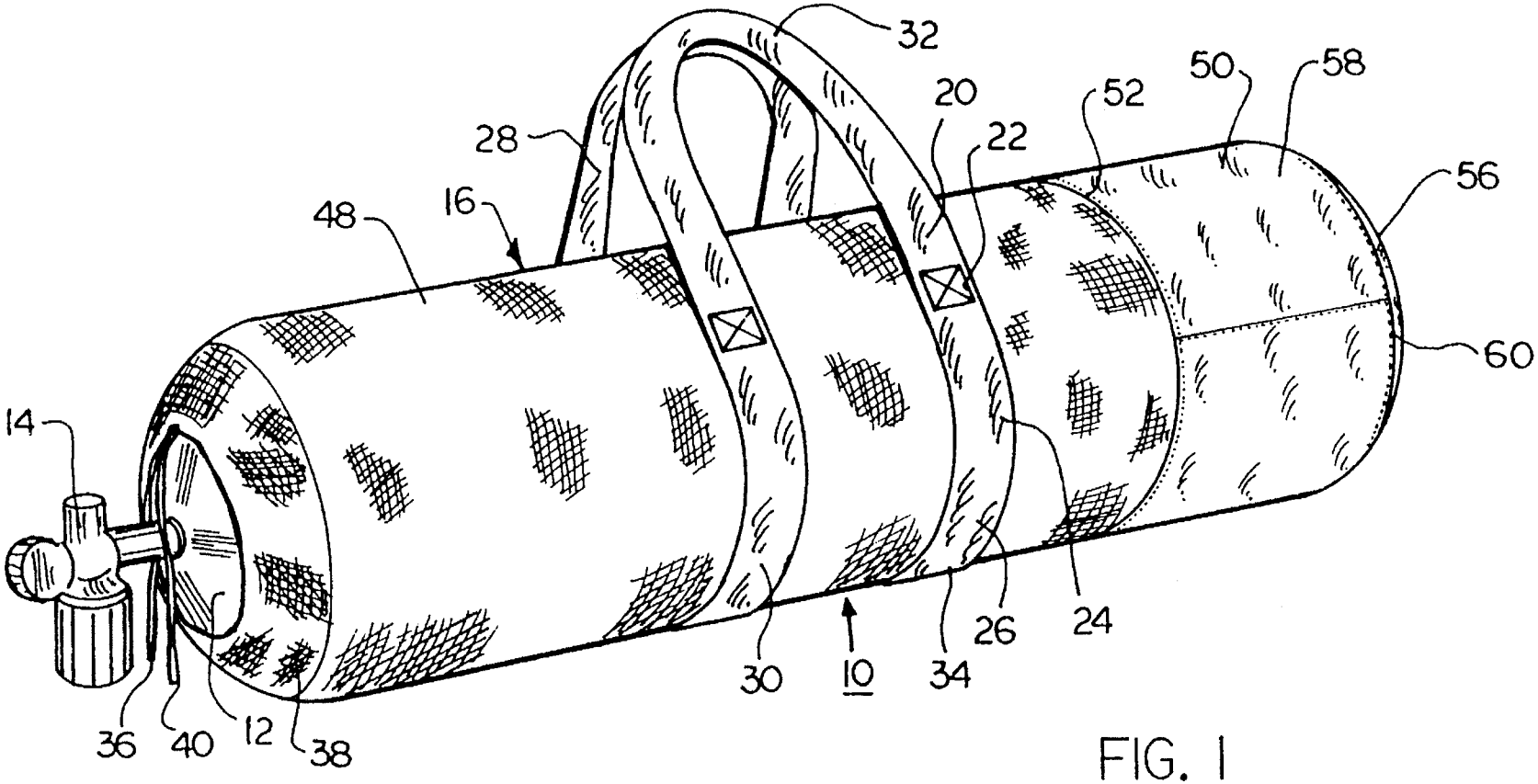
FIG. 1 is a perspective view of a scuba tank equipped with a carrier according to an embodiment of the invention.

Referring now to FIG. 1, there is shown a tank carrier 10 mounted on and equipped for carrying a tank 12. As can be seen, the tank 12 has a nipple end 14 provided with a regulator attachment through which air can be withdrawn at a controlled rate for breathing.

The carrier 10 is largely made up of a porous fabric bag 16. The bag 16 is sized to snugly fit on the tank 12. Thus, various sizes of bags are desirable to fit on various sizes of scuba tanks. Currently, the standard scuba tank sizes are 50 cubic feet, 63 cubic feet, 80 cubic feet and 100 cubic feet as well as 10 liters, 12 liters and 15 liters. The sizing of the bag to match the tank size so as to get a snug fit can be carried out in a straightforward fashion.

The upper part 48 of the bag is made of a raschel warp-knit, mesh fabric. The fibers are preferably polyester, although other materials could be used. The preferred knit is a 3-bar construction. Alternate fabrics can be substituted, such as tricot and the like. Preferably, the fabric is heat-set so as to be dimensionally stable and unlikely to stretch. This will assure that the fabric will maintain its snug fit on the tank even during repeated wettings and dryings, to which the tank 12 and fabric bag 16 will be exposed.

The bag bottom 50 is of a different fabric, designed to have greater abrasion resistance than the raschel warp knit fabric. The bag bottom 50 is made up of a wrapping portion 58 and an end cap 56, both of the more durable fabric. The wrapping portion is seamed at 52 to the raschel knit fabric and to itself along seam 54. The end cap 56 is seamed at seam 60.

The fabric of the bag bottom 50 is preferably a woven nylon, such as nylon 6, nylon-6-6 or a ballistic nylon such as Cordura. The most preferred fabric is nylon oxford cloth of 200 denier yarns. Other even more durable fibers such as Nomex, Kevlar or Spectra could be used but, since they are much more expensive, are not preferred. The more durable fibers of the bag bottom resist abrasion to which they will be exposed on the bottom of the tank 12 if the tank is dragged on an abrasive surface.

Attached to the bag is a strap 20, preferably of one piece, although other constructions could be substituted. The one piece strap 20 is sewn to the bag beginning at a first end 26 which, in the view of the figure, begins as seen and passes under the bag and cylinder to partially encircle the bag and cylinder. As seen in the figure, the strap emerges to form a handle portion 28 which turns back down in the view of the figure to form a continuation portion 30 which partially encircles the bag and cylinder. A further continuation extends up to form another handle portion 32, terminating in a final end portion 24 abutting the first end 26. The strap is sewn to the fabric all along its length, with extra stitching in the form of box-X stitches 22 at stress points. The stress points are the points along the strap where the stitching ends. The box-X stitch provides a stronger bond to the fabric. Preferably, the ends 24 and 26 are overlapped. The strap 20, as can be seen is affixed to the bag 16 midway along its length so that, when the handles are being use to carry a cylinder, the load will be balanced.

The open end of the bag 16 is provided with a drawstring closure 36 formed in a hem in a typical drawstring formation. The drawstring may be cinched shut by a clamp 40. Preferably, the clamp is as shown in one or more of U.S. Pat. No. 3,132,390 to Boden or U.S. Pat. No. 4,102,019 to Boden, the entire disclosures of both of which are hereby incorporated herein by reference.

Figure 2:
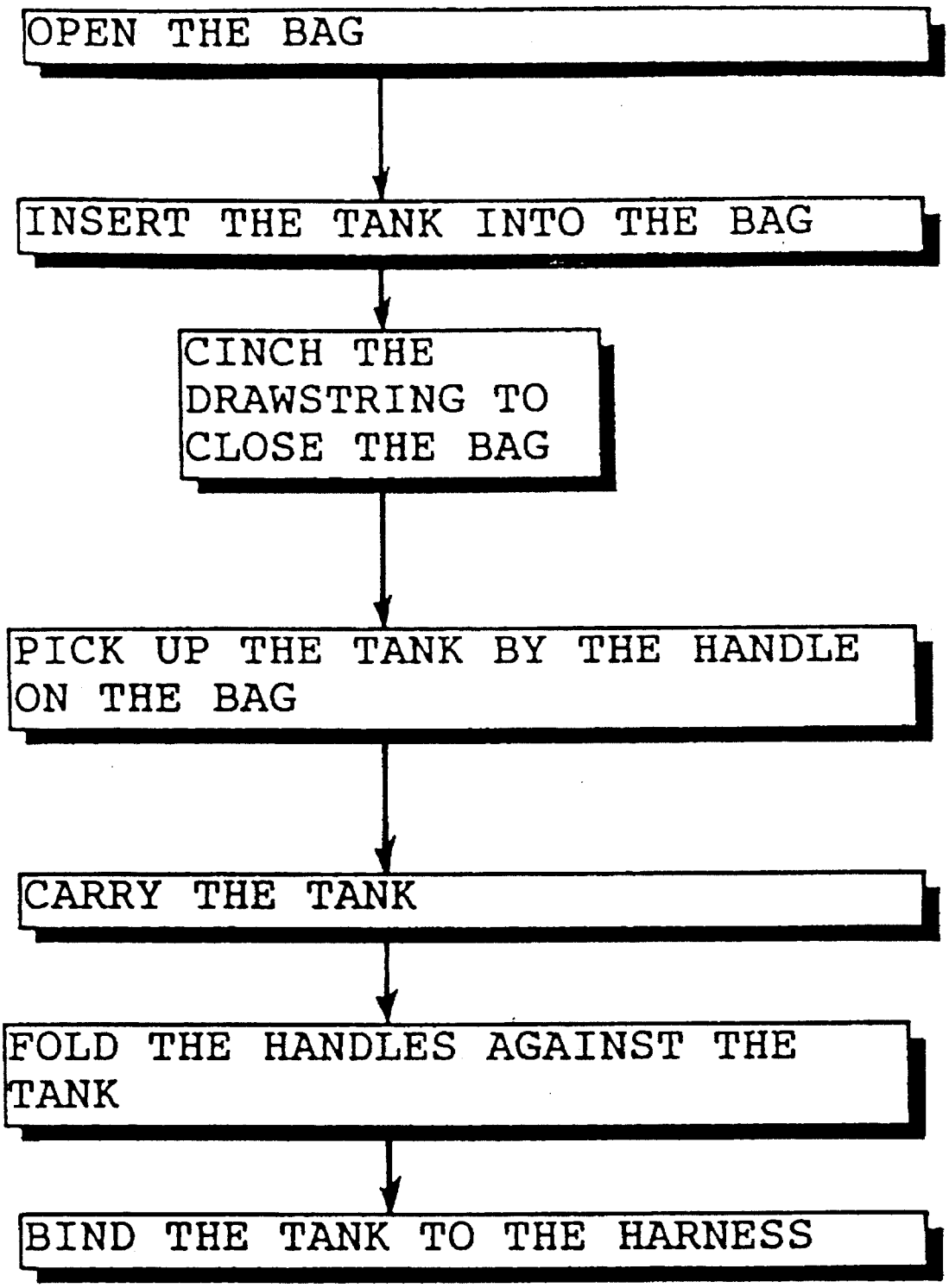
FIG. 2 is a flow chart of procedures for use of the carrier.

As seen in FIG. 2, in use, the carrier 16 can be easily affixed to the tank 12. First, a drawstring is opened and then the bottom end of the tank is inserted into the bag, with the tank being inserted as far as it will go. The size of the bag is such that the tank will be contained snugly. The tank can be held in the bag by cinching shut the drawstring 36 and clamping it shut with the clamp 40.

Then the tank and carrier can be picked up merely by grasping the handle portions 29 and 32 and carrying the tank. As can be seen, the remainder of the strap forms a supporting saddle to hold the weight of the tank.

When it comes time to make a dive, the bag need not be removed from the tank. Instead, the handle portions 28 and 32 are folded up against the outer portion of the bag 16 and the tank can be strapped onto a harness in conventional fashion, such as with a conventional buoyancy compensator. The straps will thus be out of the way, tucked between the tank and the buoyancy compensator. The dive can then take place. Since the fabric bag 16 is porous and preferably of polyester, which is hydrophobic, it will dry quickly after the dive. Water will not be trapped in the bag because the porous mesh will let the water drain out. The bag bottom 50 will protect the tank from being scratched when dragged over an abrasive surface.

The bag will also serve as a protector for the tank keeping the tanks free of nicks and bumps.

Preferably, the straps are polypropylene.

Providing the bag of a tight fit also helps to keep foreign matter and debris from coming between the bag and the tank.

Thus, the carrier can stay on the tank indefinitely, throughout many cycles of dives, refillings and storage and the transportation between them.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A carrier for a scuba tank having a nipple end and a bottom end and being of a specific size comprising a bag open at one end and sized to be snugly fitted onto the scuba tank from over the bottom end of the scuba tank, said bag having an upper portion of porous fabric and a bag bottom of an abrasion-resistant fabric, and a strap having a first portion sewn to said bag and in encircling relation to at least a portion of said bag and a handle portion, whereby said fabric bag can be snugly fitted onto the scuba tank from over the bottom end of the scuba tank and the combined scuba tank and bag nay be conveniently carried using the strap handle portion as a handle, with said first portion of said strap providing support for the tank.

2. A carrier as claimed in claim 1 wherein said upper portion fabric is a mesh fabric.

3. A carrier as claimed in claim 1 wherein said upper portion fabric is made of a raschel warp knit mesh fabric that has been heat-set to remove most of its stretch.

4. A carrier as claimed in claim 1 wherein said bag bottom is of a fabric woven of yarns of a fiber selected from the group consisting of nylon, nylon-6, nylon-6-6, Kevlar, Nomex and Spectra.

5. A carrier as claimed in claim 1 wherein said bag bottom is of a fabric woven of 200 denier nylon yarns.

6. A carrier as claimed in claim 1 wherein said strap is a single strap having a first end sewn to said bag, a first continuation forming a first handle loop, a second continuation sewn to and partially encircling said bag, a third continuation forming a second handle loop, and a fourth continuation sewn to and partially encircling said bag and substantially meeting said first end, whereby said strap forms a saddle supporting the carried tank.

7. A carrier as claimed in claim 1 wherein said strap is sewn to said bag at stress points with a box-X stitch.

8. A carrier for a scuba tank having a nipple end and a bottom end comprising a bag open at one end and sized to be snugly fitted onto the scuba tank over the bottom end of the scuba tank and having an upper portion of a porous, raschel warp knit mesh fabric that has been heat-set to have very little stretch and a bag bottom made of a fabric of woven nylon yarns, a drawstring closure for said open end of said bag to permit selective opening and closing of said open bag, and a strap having 1) a first end sewn to said bag,
2) a first continuation forming a first handle loop,
3) a second continuation sewn to and partially encircling said bag,
4) a third continuation forming a second handle loop, and
5) a fourth continuation sewn to and partially encircling said bag and substantially meeting said first end, whereby said fabric bag can be snugly fitted onto the scuba tank from over the bottom end of the scuba tank, the open end of the bag can be closed by the closure and the combined scuba tank and bag can be conveniently carried using the first and third continuations of said strap as a handle, with said first end and said second and fourth continuations of said strap providing saddle support for the tank.

9. A scuba diving assembly comprising a scuba tank having a nipple end and a bottom end and being of specific size and a carrier for said scuba tank including 1) a porous bag having an upper portion made of a raschel warp knit mesh fabric that has been heat-set to remove most of its stretch and a bag bottom of woven nylon yarns, and said bag being open at one end and snugly fitted onto said scuba tank with said open end adjacent said nipple end of said tank, and 2) a strap having a first portion sewn to said bag and in encircling relation to at least a portion of said bag and a handle portion, whereby the combined scuba tank and bag may be conveniently carried using the strap handle portion as a handle, with said first portion of said strap providing support for the tank.

* * * * *